United States Patent [19]

Bachmann

[11] Patent Number: 4,524,956

[45] **Date of Patent: * Jun. 25, 1985**

[54] LINEAR SLIDING CLOSURE UNIT

[75] Inventor: Herbert Bachmann, Ebikon, Switzerland

[73] Assignee: Stopinc Aktiengesellschaft, Baar, Switzerland

[ * ] Notice: The portion of the term of this patent subsequent to Jan. 10, 2001 has been disclaimed.

[21] Appl. No.: 526,131

[22] Filed: Aug. 24, 1983

Related U.S. Application Data

[63] Continuation of Ser. No. 371,486, Apr. 23, 1982, Pat. No. 4,424,958.

[30] Foreign Application Priority Data

May 19, 1981 [CH] Switzerland ..... 3255/81

[51] Int. Cl.[3] ..... B22D 37/00

[52] U.S. Cl. ..... 266/236; 266/271; 222/600

[58] Field of Search ..... 266/271, 236; 222/600, 222/599, 601, 603

[56] References Cited

U.S. PATENT DOCUMENTS

| | | | |
|---|---|---|---|
| 3,866,806 | 2/1975 | Shapland, Jr. | 222/600 |
| 4,063,668 | 12/1977 | Shapland et al. | 222/600 |

FOREIGN PATENT DOCUMENTS

| | | | |
|---|---|---|---|
| 0060888 | 4/1974 | Australia | 222/600 |
| 1935401 | 12/1970 | Fed. Rep. of Germany | 222/600 |
| 2125175 | 5/1971 | Fed. Rep. of Germany . | |
| 2227501 | 1/1973 | Fed. Rep. of Germany . | |
| 2746265 | 4/1978 | Fed. Rep. of Germany . | |
| 3013975 | 12/1980 | Fed. Rep. of Germany . | |
| 1440916 | 6/1976 | United Kingdom . | |
| 1492534 | 11/1977 | United Kingdom . | |
| 1495400 | 12/1977 | United Kingdom . | |
| 2031567 | 4/1980 | United Kingdom . | |
| 1568654 | 6/1980 | United Kingdom . | |
| 1584628 | 2/1981 | United Kingdom . | |

*Primary Examiner*—Melvyn J. Andrews
*Assistant Examiner*—S. Kastler
*Attorney, Agent, or Firm*—Wenderoth, Lind & Ponack

[57] ABSTRACT

A linear sliding closure unit includes a stationary refractory plate, a closure casing adapted to be mounted on a molten metal container, a linearly movable sliding refractory plate, a sliding closure member mounting the sliding refractory plate for linear sliding movement relative to the casing and the stationary refractory plate, and structure for urging the sliding refractory plate toward the stationary refractory plate so that respective sliding surfaces thereof are in abutment. The closure casing includes an inner supporting surface supporting and defining the position of the stationary refractory plate. The closure casing has guide surfaces at positions outwardly of the support surface, the sliding closure member being guided by the guide surfaces during sliding movement. The closure casing fixedly connects and spaces the guide surfaces from the supporting surface.

3 Claims, 5 Drawing Figures

LINEAR SLIDING CLOSURE UNIT

This is a continuation of application Ser. No. 371,486, filed Apr. 23, 1982 now U.S. Pat. No. 4,424,958.

BACKGROUND OF THE INVENTION

The present invention relates to an improved linear sliding closure unit for use in discharging molten metal from a container. More particularly, the present invention is directed to such a linear sliding closure unit of the type including a stationary refractory plate having therethrough a discharge outlet aligned with a discharge outlet through the wall of the container, a closure casing adapted to be mounted on the molten metal container, a linearly movable sliding refractory plate having therein at least one discharge opening, a sliding closure member mounting the sliding refractory plate for linear sliding movement relative to the casing and the stationary refractory plate, and structure for urging the sliding refractory plate toward the stationary refractory plate so that respective sliding surfaces thereof are in abutment. During sliding movement of the sliding closure member and the sliding refractory plate, the discharge opening through the sliding refractory plate is moved between an open position aligned with the opening through the stationary refractory plate and a closed position out of such alignment and blocking discharge of molten metal from the container.

In known linear sliding closure units of this type, for example as disclosed in West German DE-OS No. 22 27 501, the stationary fireproof refractory plate is part of a mounting plate which is fastened to the molten metal container. The closure casing contains the sliding closure member and the sliding fireproof refractory plate and is hinged at one of its side walls to the mounting plate. To connect the closure casing and the mounting plate for operational purposes, each side wall of the closure casing has a bent lever closure member. These two members have to be operated at the same time in order to close the casing. This arrangement also results in a tightening of clamping devices between the sliding closure member and the sliding refractory plate. Such clamping devices are in the form of a plurality of pressure springs inserted loosely in the sliding closure member. When the bent lever closure members are opened and the closure casing is swung outwardly, the sliding refractory plate, as well as the stationary refractory plate, can be removed. Only then are the pressure springs accessible for adjustment or replacement. The amount and the distribution of the contact pressure which the pressure springs exert on the sliding refractory plate depend directly on the position of the sliding closure member which moves linearly within the closure casing, and thus depend on the position of the closure casing with respect to the mounting plate. Because the bent lever closure members have a multitude of moving joints and are operated frequently and under conditions of high mechanical stress, it therefore occurs that an unchangeable and accurately repeatable operational position of the closure casing is not possible, or if possible only with considerable effort of control and maintenance. Thus, known linear sliding closure units of this type inherently have the disadvantage of varied and unevenly distributed contact pressure between the sliding refractory plate and the stationary refractory plate.

SUMMARY OF THE INVENTION

With the above discussion in mind, it is an object of the present invention to provide an improved linear sliding closure unit of the type discussed above but wherein the disadvantages of prior art such units are overcome.

It is a more specific object of the present invention to provide such an improved linear sliding closure unit during the operation of which the contact pressure between the sliding surfaces of the two refractory plates is as constant and as evenly distributed as possible, thereby avoiding so called "tilting" of the sliding refractory plate during operation.

It is a further object of the present invention to provide such an improved linear sliding closure unit capable of achieving such constant and evenly distributed pressure, without the requirement for adjustment and maintenance, even after many opening and closing operations are performed.

These objects are achieved in accordance with the present invention by providing that the closure casing includes an inner supporting surface supporting and defining the position of the stationary refractory plate, that the closure casing includes structure defining guide surfaces at positions outwardly of the supporting surface, the sliding closure member being guided by the guide surfaces during sliding movement, and that the sliding closure casing includes fixed structure connecting and spacing the guide surfaces from the supporting surface. By these structural features, the closure casing is constructed as a complete, form-locking unit which specifically defines in a precise manner the spacing between the mounting of the stationary refractory plate and the sliding movement of the sliding closure member. Thereby the prior art disadvantages are avoided, and additionally the construction and maintenance of the unit are simplified considerably.

In accordance with a preferred aspect of the present invention the sliding closure member is exposed to the exterior through an open outer portion of the closure casing, and the urging structure comprise plural members insertable into and removable from the sliding closure member through such open outer portion. As employed herein, the terms "outer" and "inner" refer to the relative locations of various elements with respect to the molten metal container. This feature of the present invention makes it possible to assemble and/or disassemble the unit without interference from the clamping devices, i.e. the urging structure.

In a preferred aspect of the present invention, the sliding closure member comprises a sliding carriage supported on the guide surfaces, a supporting frame separate from the sliding carriage and supporting the sliding refractory plate, and structure for connecting the supporting frame to the sliding carriage such that sliding movement of the sliding carriage is transferred to the supporting frame and the sliding refractory plate. The connecting structure may comprise carrier bolts fixed to the sliding carriage and extending into recesses in the supporting frame, the carrier bolts being positioned symmetrically of the sliding refractory plate with respect to a central axis thereof extending transverse to the direction of sliding movement thereof.

In a further preferred aspect of the present invention, the urging structure comprises a plural hollow bolts threaded into holes in the sliding carriage, and axially movable elements positioned within the hollow bolts and compressed between the bolts and the supporting frame for urging the supporting frame and the sliding refractory plate away from the sliding carriage and toward the stationary refractory plate.

In accordance with a further feature of the present invention, the plural urging members are positioned symmetrically of the sliding refractory plate with respect to a first central axis thereof extending in the direction of sliding movement thereof and with respect to a second central axis thereof extending transverse to the first central axis. The sliding surface of the stationary refractory plate is sufficiently larger than the sliding surface of the sliding refractory plate such that the entire sliding surface of the sliding refractory plate is in abutment with the sliding surface of the stationary refractory plate at all sliding positions of the sliding refractory plate. Two of the plural urging members may be positioned along the first central axis. Alternatively, four such plural urging members may be provided, but in symmetric alignment with respect to the first and second central axes. These features of the present invention facilitate achieving the feature that the pressure between the sliding surfaces of the two refractory plates is evenly distributed, independently of the position of the sliding closure member.

In one arrangement of the present invention, the guide surfaces are formed on a pair of members extending parallel to the direction of sliding movement of the sliding closure member, such members being removably connected to outer surfaces of spaced side walls of the closure casing. Thereby, removal of such members enables removal of the sliding closure member and the sliding refractory plate through the open outer portion of the closure casing.

In another arrangement of the present invention, the guide surfaces are provided on integral portions unitary with outer portions of spaced side walls of the closure casing. The closure casing includes at one end thereof a removable end wall. Thereby, removal of the end wall enables removal of the sliding closure member and the sliding refractory plate by sliding thereof through such open one end.

BRIEF DESCRIPTION OF THE DRAWINGS

Other objects, features and advantages of the present invention will be apparent from the following detailed decription of preferred embodiments thereof, with reference to the accompanying drawings, wherein.

DETAILED DESCRIPTION OF THE INVENTION

Figure 1:
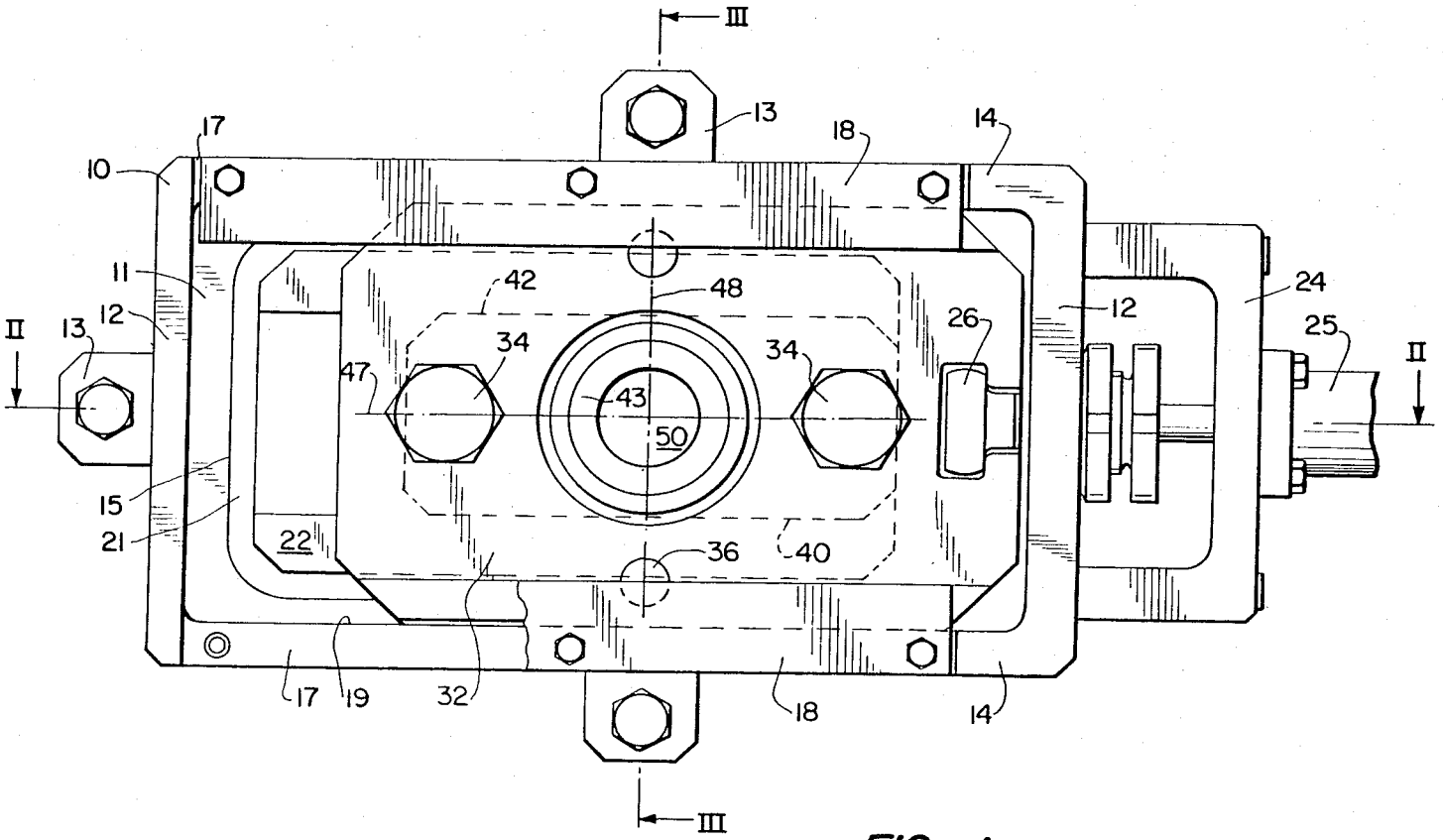
FIG. 1 is a bottom elevation view of one embodiment of the improved linear sliding closure unit of the present invention.
Figure 2:
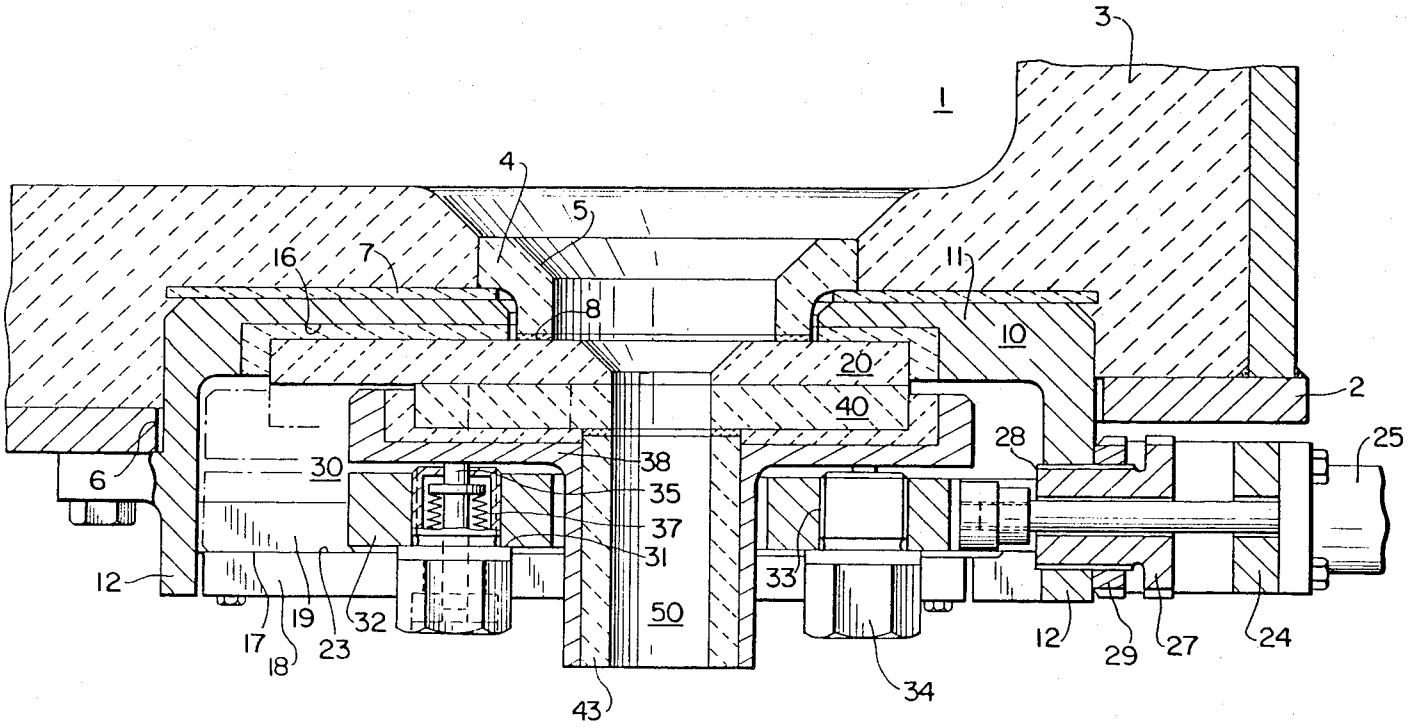
FIG. 2 is a longitudinal cross-sectional view taken along line II—II of FIG. 1, but additionally showing portions of a molten metal container to which the unit of the present invention is attached.
Figure 3:
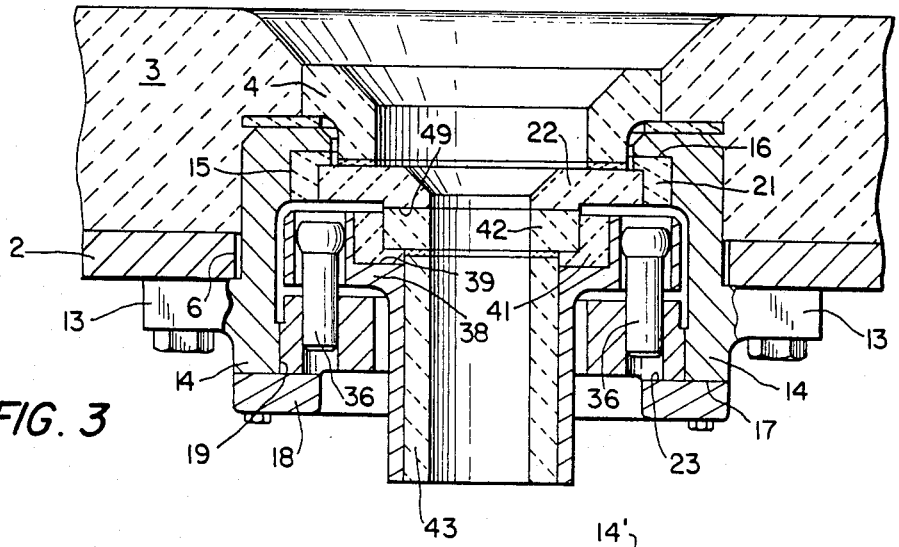
FIG. 3 is a transverse cross-sectional view taken along line III—III of FIG. 1, also showing portions of the molten metal container.

With reference now to FIGS. 1–3, a first embodiment of the present invention will be described. Shown in FIGS. 2 and 3 are portions of a molten metal container adapted to contain molten metal and to which the linear sliding closure unit of the present invention may be attached. Thus, the molten metal container is indicated generally at 1 and can be, for example, a melting furnace, a holding container, a treatment or transport container or a similar container, as will be apparent to those skilled in the art. Container 1 includes an outer metal jacket 2 and an inner fireproof refractory brick lining 3. The container includes a discharge area having a fireproof refractory perforated brick 4 having therein a discharge hole 5. Jacket 2 has therein an opening 6 joining a recess in the refractory lining 3 for receipt of the unit of the present invention.

The linear sliding closure unit includes a closure casing 10 extending through opening 6 and mounted on jacket 2 by means of bolts extending through lugs 13. Casing 10 is formed of metal, and an inner portion 11 of the casing is insulated from the refractory portions 3, 4 of the container by means of an intermediate layer 7 of a fireproof material having the property of poor heat conductivity. A stationary fireproof refractory plate 20 is fixedly positioned and may be connected to brick 4 by means of a ring-shaped refractory mortar joint 8.

The unit further includes a metal sliding closure member 30 supporting a sliding refractory plate 40. As shown, stationary refractory plate 20 has therethrough a discharge opening aligning with opening 5 in brick 4, and sliding refractory plate 40 has therethrough at least one discharge opening, which when aligned with the discharge opening in plate 20 forms, with a discharge opening in a refractory pouring spout 43, and continuous discharge conduit 50. The drawings illustrate the unit in the opened, discharged position. When the sliding closure member 30 and the sliding refractory plate 40 are moved linearly, for example by a hydraulic cylinder 25, the sliding closure member 30 and the sliding refractory plate 40 are moved to a closed position, shown in dashed lines in FIG. 2, thereby closing conduit 50 and preventing discharge of molten metal from the container 1. It is to be noted that as employed herein the terms "refractory" and "fireproof" are intended to have the conventional meanings known in the art.

Closure casing 10 includes, in addition to inner portion 11, spaced end walls 12 and spaced side walls 14. Inner portion 11 has therein a recess 15 defining an inner supporting surface 16 which supports and defines the position of stationary refractory plate 20. Thus, in accordance with the present invention the stationary refractory plate is positioned by surface 16 of the closure casing 10 and not by portions of the container 1.

As shown, the stationary refractory plate 20 preferably may consist of two components, i.e. plate component 22 having the discharge opening and a sliding surface 49, and an intermediate layer 21 positioned against surface 16 and being formed of a fireproof refractory thermal insulation material, thereby insulating plate component 22 from casing 10. In a similar manner, sliding refractory plate 40 may be formed of a plate component 42 having a sliding surface in sliding abutment with sliding surface 49 of plate component 22, as well as a thermal insulation intermediate layer 41 supporting plate component 42 on a precisely finished supporting surface 39 in a metal supporting frame 38 which is a portion of the sliding closure member 30.

The outer portion of closure casing 10 is open, such that the sliding closure member 30 is exposed to the exterior through such open outer portion. Outer surfaces 17 of side walls 14 of casing 10 are machined and have removably attached thereto members 18 extending parallel to the direction of sliding movement of sliding closure member 30. Members 18 define precise guide surfaces 23. Thus, the fixed spacing between surfaces 16, 17 of casing 10 is precisely maintained, thereby insuring fixed relative positioning between stationary refractory plate 20 and a sliding carriage 32 of sliding closure member 30. As shown particularly in FIG. 3 of the drawings, sliding carriage 32 has finished surfaces sliding on finished surfaces 23, and also has finished lateral surfaces in sliding contact with finished surfaces 19 of walls 14 of casing 10, thus insuring precise positioning of sliding carriage 32.

Hydraulic cylinder 25 is connected to casing 10 by means of a bracket 24, and is designed for achieving linear sliding movement of sliding closure member 30 along surfaces 23, 19 and of sliding refractory plate 40 along stationary refractory plate 20. The connecting rod of the cylinder 25 has a head 26 which fits into a recess extending entirely through sliding carriage 32. A pair of carrier bolts 36 are fixed to sliding carriage 32 and extend into recesses in supporting frame 38. Thus, movement of sliding carriage 32 is transmitted by carrier bolts 36 to support frame 38. A sleeve 27 surrounds the piston rod of the cylinder 25 and is threaded into an end wall 12 of casing 10. Sleeve 27 is secured by a lock nut 29 and provides and inner abutment surface 28 serving as a stop for the sliding carriage 32 when the unit is in the open position shown in the drawings, thereby making it possible to precisely align the openings through plates 20, 40.

Clamping devices 34 are provided to urge to the sliding refractory plate 40 toward the stationary refractory plate 20 so that the respective sliding surfaces thereof are in abutment. In accordance with the specifically preferred arrangement of the present invention, each clamping device 34 includes a hollow bolt screwed into a threaded hole 33 in sliding carriage 32 until a head of the bolt is tightened against an abutment surface 31 of sliding carriage 32. Within the hollow of bolt 34 is an axially movable member 35. Suitable springs, for example a set of cup springs 37, are compressed between the head of the bolt 34 and a collar on axially movable member 35, thereby urging member 35 outwardly of bolt 34 and into abutting contact with an outer surface of support frame 38. Thereby, the clamping devices 34 urge the supporting frame and sliding refractory plate 40 toward stationary refractory plate 20 such that the mutually engaging sliding surfaces thereof are in abutment. Due to the open outer portion of casing 10, clamping devices 34 may be insertable into and removable from the sliding closure member through the open outer portion, and are easily and readily accessible from the exterior.

During disassembly of the unit, clamping devices 34 are unscrewed and/or loosened enough so that there is no contact pressure between plates 20, 40. Members 18 are removed from side walls 14 by removal of the bolts therein. Sliding closure unit 30 may then easily be removed in an outward direction, it being noted that the recess into which head 26 fits extends entirely through sliding carriage 32. Stationary refractory plate 20 then also can be removed from the casing. In this manner it is relatively easy to inspect and/or replace the refractory plates. Due to the rigid manner of construction of the casing 10 between the supporting surface 16 for plate 20 and the surfaces 17 for mounting members 18 defining guide surfaces 23, it is possible to obtain automatically a precisely defined "base" for the sliding closure member with respect to the stationary refractory plate. Furthermore, this arrangement enables the contact pressure exerted by clamping devices 34 to be maintained within predetermined, narrow limits, with given dimensions and compressions for springs 37, when the unit is being assembled and the clamping devices 34 are installed and tightened against stops 31.

Additional features of the present invention insure that the contact pressure between the sliding surfaces of plates 20, 40 is distributed evenly over the sliding surface 49, at any sliding position of the sliding closure member 30, and even during such sliding movements.

The first such feature involves the installation of clamping devices 34 symmetrically in sliding carriage 32, and more specifically symmetrically with respect to the dimensions of sliding refractory plate 40, both in the direction of sliding movement thereof as well as in directions at a right angle to sliding movement. Thus, as shown in FIG. 1, it is possible to provide only two clamping devices 34, with both devices 34 being positioned symmetrically along a first central axis of plate 40 extending in the direction of sliding movement thereof. Furthermore, both devices 34 are symmetrically positioned with respect to a second central axis 48 of plate 40 extending transversely at a right angle to first central axis 47. As shown in FIG. 3, the abutting sliding surface of plate 40 has the same transverse width as surface 49 of plate 20. However, as shown in FIG. 2, plate 20 has a dimension in the direction of sliding movement sufficiently greater than the dimension of plate 40 such that the entire sliding surface of plate 40 is in abutment with sliding surface 49 of plate 20 at all sliding positions of plate 40. This insures that for all positions of sliding refractory plate 40 the area of mutual abutment between the sliding surfaces will be equal. Also, the contact pressure, that is the pressure per unit of area of the abutting surfaces, is constant at a given contact pressure for the clamping devices.

The transfer of sliding movement from sliding carriage 32 to supporting frame 38 by means of carrier bolts 36 achieves a precise guiding of plate 40 during the sliding operation. The application of power by bolts 36 to the supporting frame 38 occurs at a level closely adjacent the plane of the abutting surfaces of the refractory plates. As shown in FIG. 1, bolts 36 are positioned symmetrically with respect to axes 47 and 48, and thus symmetrically with respect to the dimensions of plate 40. This type of connection insures than an even distribution of surface pressure exists even during sliding movement.

The evenly distributed and constant surface pressure between the sliding surfaces of plates 20, 40 prevents damaging tilting moments and end pressures from occurring during sliding movement. This results in extremely low levels of and even wear, not only for the sliding surfaces of the plates 20, 40, but also of the metallic sliding surfaces between carriage 32 and casing 10. The constant, full contact between the sliding surfaces of plates 20, 40 also prevents air from moving along the sliding surfaces and reaching the out flowing molten metal. In particular, this feature prevents molten metal "tongues" from being pulled between the plates during a sliding operation. This characteristic of the present invention makes it possible to carry out a great number of opening and closing operations without maintenance or repair and makes the unit of the present invention particularly well suited for metering out specific amounts of molten metal, for example in the production of castings, and further particularly when metals other than iron are involved.

Figure 4:
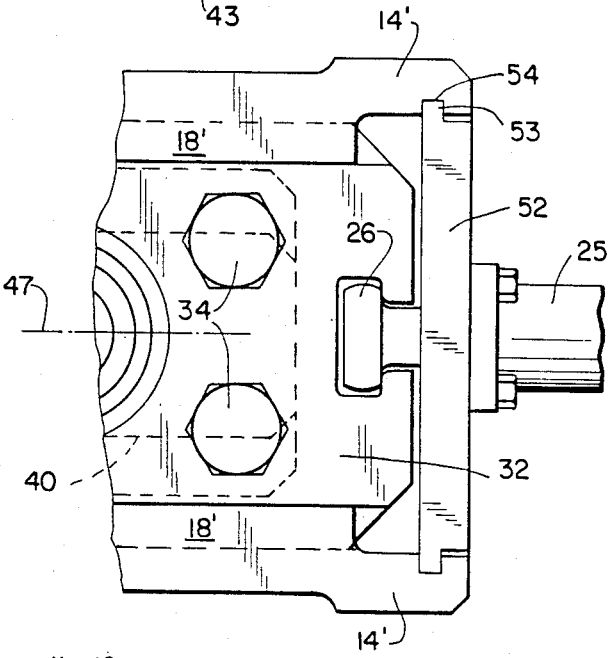
FIG. 4 is a partial bottom elevation view of a second embodiment of the linear sliding closure unit of the present invention.
Figure 5:
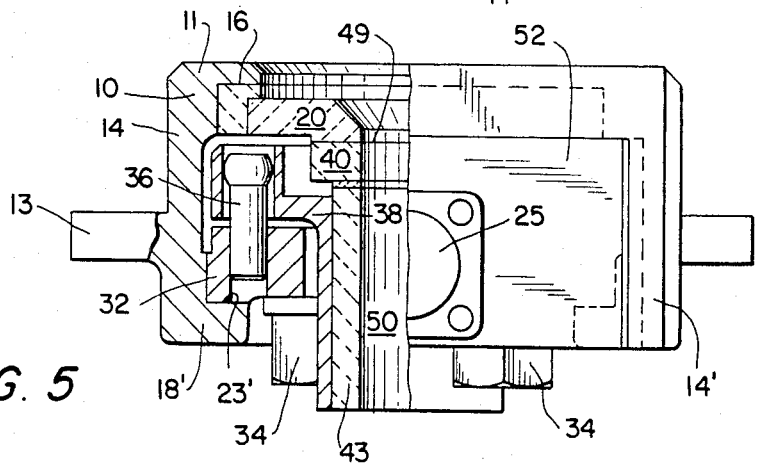
FIG. 5 is a transverse view of the arrangement of FIG. 4, the left hand portion of FIG. 5 showing the unit in cross-section, and the right hand portion of FIG. 5 showing the unit in elevation.

With reference now to FIGS. 4 and 5 of the drawings, a second, somewhat modified embodiment of the present invention will be described. In this embodiment of the present invention, the members 18', corresponding to members 18 of the embodiment of FIGS. 1–3, are integral portions unitary with side walls 14 of casing 10. Guide surfaces 23' for sliding carriage 32 are precisely machined on integral portions 18'. By this arrangement, it is not possible to remove the sliding closure member in an outward direction. To make it still possible to remove or install the sliding closure member, casing 10 is provided at one end thereof with a removable end wall 52. Specifically, wall 52 has at opposite sides thereof a pair of projections or tongues 53 which fit within grooves 54 at side portions 14' of opposite end walls 14 of the casing. Therefore, after removal of a mounting safety device, not shown, end wall 52 can slide in an outward direction along grooves 54. Cylinder 25 is mounted directly on wall 52 such that upon removal of wall 52, cylinder 25 and head 26 also are removable in the same direction. Thereafter, upon removal or loosening of clamping devices 34, the entire unit of sliding closure member 30 and sliding refractory plate 40 may be removed through the opened end of casing 10, i.e. in a rightward direction as viewed in FIG. 4. In the arrangement of FIGS. 4 and 5, there are provided four clamping devices 34, although only those two devices 34 located closest removable wall 52 are shown. The four devices 34 are all arranged symmetrically of sliding refractory plate 40, i.e. symmetrically with respect to axes 47, 48.

Although the present invention has been described and illustrated with respect to preferred features thereof, it is to be understood that various modifications as will be apparent to those skilled in the art may be made to the specifically described and illustrated features without departing from the scope of the present invention. It further is to be understood that various of the alternative features disclosed in the embodiments of FIGS. 1–3 and FIGS. 4 and 5 may be interchangeable.

What I claim is:

1. In a linear sliding closure unit for use in discharging molten metal from a container and of the type including a stationary refractory plate, a closure casing adapted to be mounted on the molten metal container, a linearly movable sliding refractory plate, a sliding closure member mounting said sliding refractory plate for linear sliding movement relative to said casing and said stationary refractory plate, and means for urging said sliding refractory plate toward said stationary refractory plate so that respective sliding surfaces thereof are in abutment, the improvement wherein:

said closure casing includes an inner supporting surface supporting and defining the position of said stationary refractory plate;

means on said closure casing defining guide surfaces at positions outwardly of said supporting surface;

said sliding closure member includes a sliding carriage adapted to be moved linearly and guided by said guide surfaces during linear sliding movement, a supporting frame separate from said sliding carriage and supporting said sliding refractory plate, and connecting means for connecting said sliding carriage to said supporting frame and thus for transmitting sliding movement of said sliding carriage to said supporting frame and said sliding refractory plate;

said sliding refractory plate is movable with respect to said sliding carriage in a direction transverse to said sliding surfaces and to said direction of sliding movement;

said urging means are mounted on said sliding closure member for sliding movement therewith and urge said sliding refractory plate away from said sliding carriage and toward said stationary refractory plate; and said closure casing including fixed structure rigidly connecting and spacing said guide surfaces a predetermined fixed distance from said supporting surface.

2. The improvement claimed in claim 1, wherein said plural members urging means comprise positioned symmetrically of said sliding refractory plate with respect to a first central axis thereof extending in the direction of sliding movement thereof and with respect to a second central axis thereof extending transverse to said first central axis.

3. The improvement claimed in claim 1, wherein said guide surface defining means comprise integral portions unitary with outer portions of spaced side walls of said closure casing.

* * * * *